US008650878B2

(12) United States Patent
Mehra et al.

(10) Patent No.: US 8,650,878 B2
(45) Date of Patent: Feb. 18, 2014

(54) TURBINE SYSTEM INCLUDING VALVE FOR LEAK OFF LINE FOR CONTROLLING SEAL STEAM FLOW

(75) Inventors: Mahendra Singh Mehra, Bangalore (IN); Nestor Hernandez Sanchez, Schenectady, NY (US); Jegadeesan Maruthamuthu, Bangalore (IN); Rajasekar Natarajan, Bangalore (IN); Manikandan Srinivasan, Bangalore (IN)

(73) Assignee: General Electric Company, Schenectady, NY (US)

( * ) Notice: Subject to any disclaimer, the term of this patent is extended or adjusted under 35 U.S.C. 154(b) by 1023 days.

(21) Appl. No.: 12/715,681

(22) Filed: Mar. 2, 2010

(65) Prior Publication Data

US 2011/0214426 A1 Sep. 8, 2011

(51) Int. Cl.
*F01K 13/02* (2006.01)
*F01K 7/22* (2006.01)

(52) U.S. Cl.
USPC ..... 60/646; 60/657; 60/662; 60/663; 60/679; 60/653

(58) Field of Classification Search
USPC ..... 60/646, 657, 653, 662, 663, 677–679; 415/111–113, 170.1–174.5, 229–231
See application file for complete search history.

(56) References Cited

U.S. PATENT DOCUMENTS

| | | | | |
|---|---|---|---|---|
| 3,604,206 | A * | 9/1971 | Baily | 60/644.1 |
| 3,935,710 | A | 2/1976 | Dickinson | |
| 4,290,609 | A | 9/1981 | Dumont | |
| 4,541,247 | A | 9/1985 | Martin | |
| 4,793,141 | A | 12/1988 | Yanai et al. | |
| 5,344,160 | A | 9/1994 | Scarlata et al. | |
| 5,361,585 | A * | 11/1994 | Westphal et al. | 60/646 |
| 5,388,411 | A * | 2/1995 | McKeever et al. | 60/646 |
| 6,705,086 | B1 * | 3/2004 | Retzlaff et al. | 60/653 |
| 7,040,861 | B2 | 5/2006 | Clifford et al. | |
| 7,195,443 | B2 | 3/2007 | Vandervort et al. | |
| 7,461,544 | B2 | 12/2008 | Kumar et al. | |
| 2008/0169616 | A1 | 7/2008 | Awtar et al. | |

FOREIGN PATENT DOCUMENTS

JP 62199902 A 9/1987

* cited by examiner

*Primary Examiner* — Hoang Nguyen
(74) *Attorney, Agent, or Firm* — Hoffman Warnick LLC; Ernest G. Cusick

(57) ABSTRACT

A turbine system includes a valve coupled to a leak off line from a leak packing of a first turbine, the valve controlling a first steam flow used to maintain a constant self-sustaining sealing pressure to a second turbine across numerous loading conditions. A related method is also provided.

9 Claims, 2 Drawing Sheets

TURBINE SYSTEM INCLUDING VALVE FOR LEAK OFF LINE FOR CONTROLLING SEAL STEAM FLOW

BACKGROUND OF THE INVENTION

The disclosure relates generally to steam turbine technology, and more particularly, to a turbine steam seal system having a valve coupled to a leak off line for controlling a steam flow used to maintain a constant self-sustaining sealing pressure to a turbine. A related method is also provided.

Shaft packings are required to provide sealing of the turbine rotor or shaft between the turbine shells or the exhaust hood and the atmosphere. During normal turbine operations, the end packings can be divided into two distinct groups, pressure packings and vacuum packings. Pressure packings generally prevent steam from blowing out into the turbine room. High pressure and intermediate pressure turbine end packings are generally known as pressure packings. Vacuum packings generally seal against the leakage of air into the condenser. Low pressure end packings are known as vacuum packings. Known steam seal systems largely address these issues by utilizing the steam leaking from the pressure packings to help seal the vacuum packings.

Current steam seal systems are of a single set point sub-optimized design. For example, these designs may provide an unfired guarantee loading with a self-sealing load point ("SSLP") of about seventy percent (70%). When a steam turbine "self seals", the terms generally refer to the condition where pressure packing seal steam flow is sufficient to pressurize and seal the vacuum packings. In higher load conditions such as a supplementary firing, however, the pressure packing steam flow going to the steam seal header increases but the vacuum packing requirement may not vary such that the SSLP may be as low as about thirty percent (30%). The additional steam coming from the pressure packings into the steam seal system thus may be dumped to the condenser using a steam seal dump valve without extracting any work. Similarly during low load operations, the pressure packing steam seal flow may be reduced significantly from the design point, but the vacuum packing steam flow requirements again may not vary. In such a situation, the steam seal system may not be sufficient and an extra flow may be required from the throttle steam at a significant loss in performance.

BRIEF DESCRIPTION OF THE INVENTION

A first aspect of the disclosure provides a steam turbine system comprising: a high pressure (HP) turbine operatively coupled to an intermediate pressure (IP) turbine and a low pressure (LP) turbine; a steam seal header for maintaining a constant self-sustaining sealing pressure to the LP turbine using a first steam flow in a seal steam line from a seal packing of the HP turbine; a leak off line coupling a leak packing of the HP turbine to the IP turbine; and a valve coupled to the leak off line for controlling the first steam flow to the steam seal header.

A second aspect of the disclosure provides a method of operating a turbine system, the method comprising: providing a high pressure (HP) turbine operatively coupled to an intermediate pressure (IP) turbine and a low pressure (LP) turbine, and a leak off line coupling a leak packing of the HP turbine to the IP turbine; and maintaining a constant self-sustaining sealing pressure to the LP turbine by controlling, during non-full load operations, a valve coupled to the leak off line to control a first steam flow used to seal the LP turbine.

A third aspect of the disclosure provides a turbine system comprising: a valve coupled to a leak off line from a leak packing of a first turbine, the valve controlling a first steam flow used to maintain a constant self-sustaining sealing pressure to a second turbine.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

As indicated above, the disclosure provides a turbine system having a valve coupled to a leak off line for controlling a steam flow used to maintain a constant self-sustaining sealing pressure to a turbine.

Figure 1:
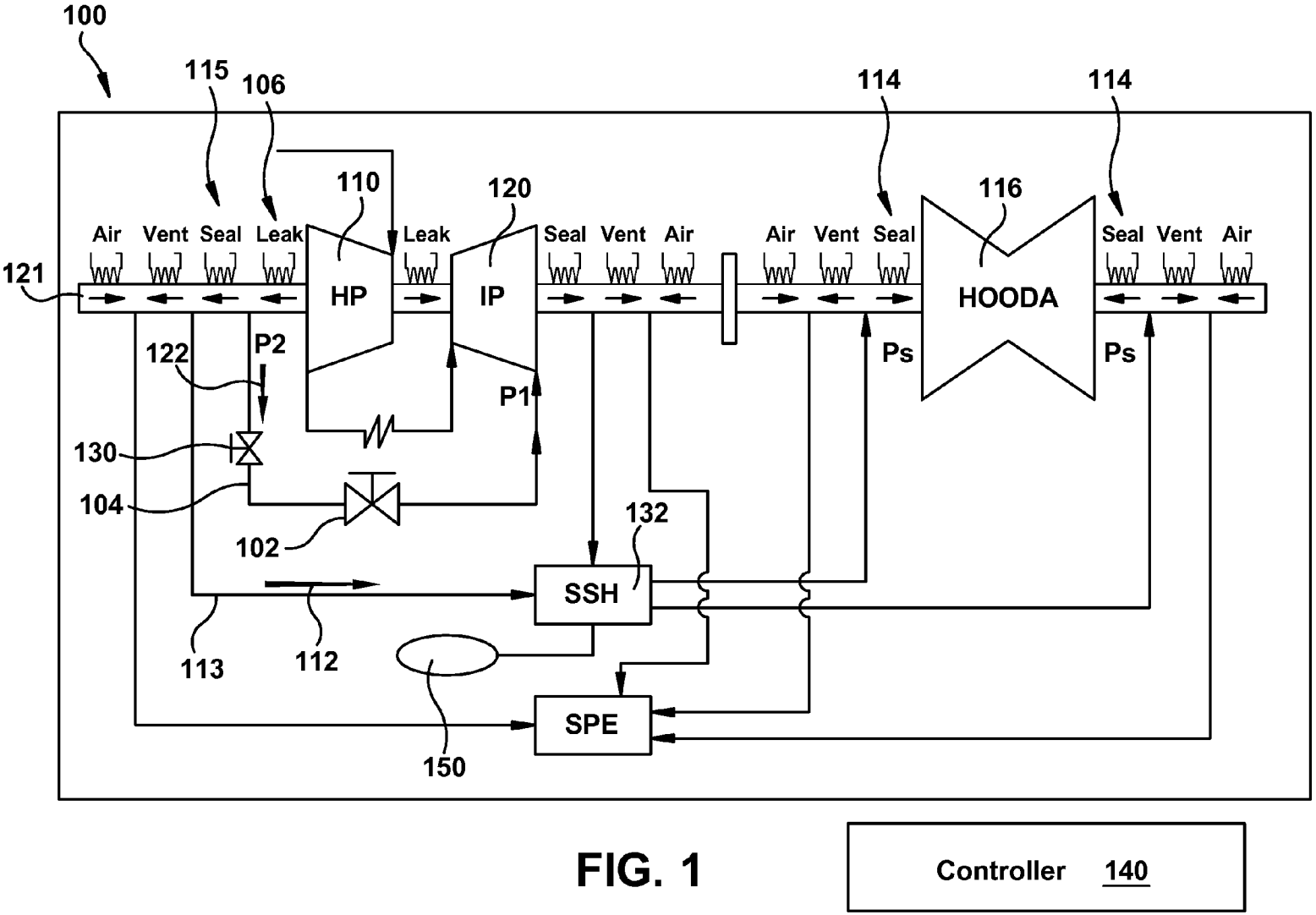
FIG. 1 shows a schematic diagram of a steam turbine system according to embodiments of the invention.
Figure 2:
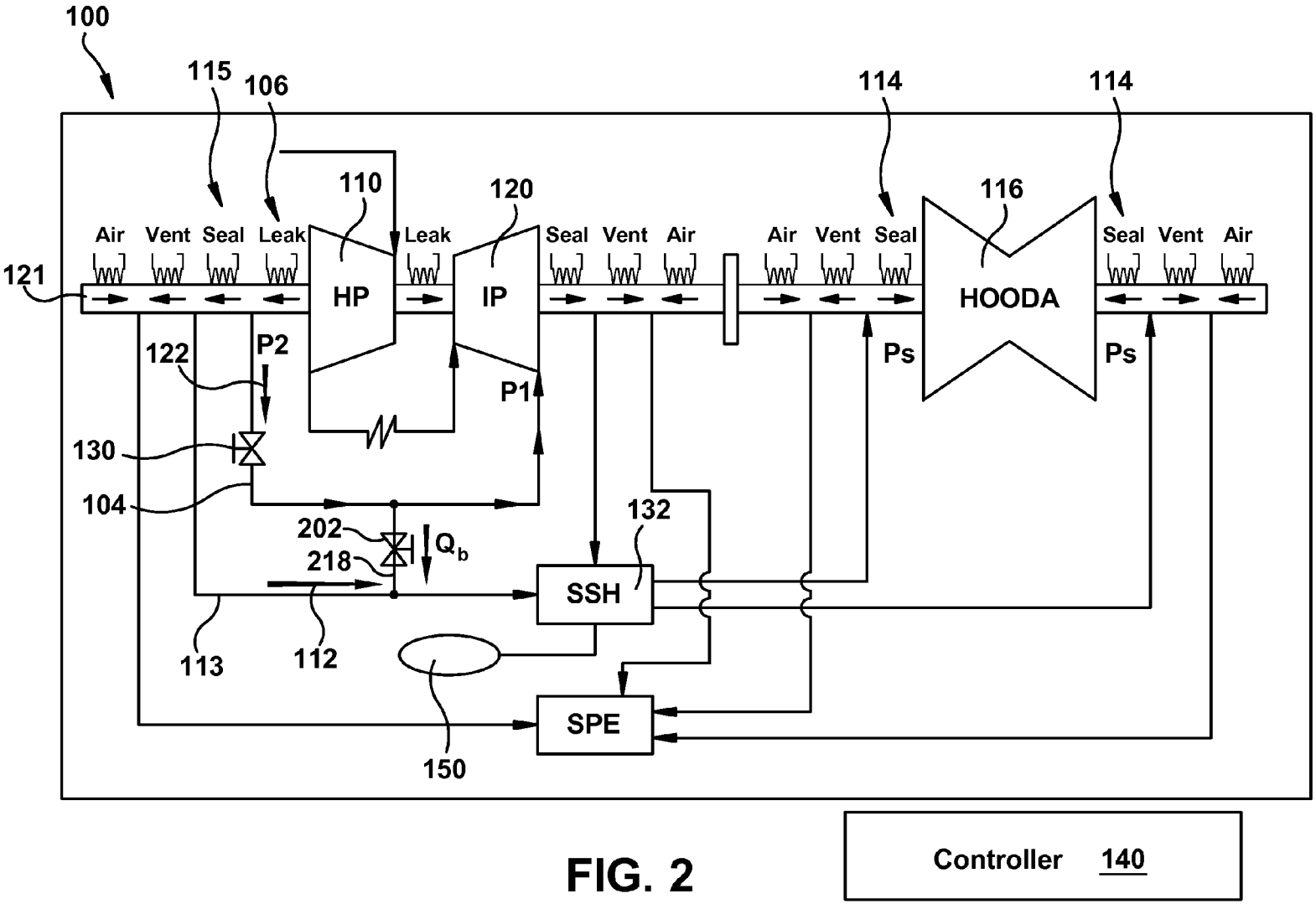
FIG. 2 shows a schematic diagram of a steam turbine system according other embodiments of the invention.

Referring to FIGS. 1 and 2, schematic diagrams of embodiments of a turbine system 100 according to the invention are illustrated. Steam turbine system 100 includes a valve 102 (FIG. 1), 202 (FIG. 2) coupled to a leak off line 104 from a leak packing 106 of a first turbine 110. In both embodiments, valve 102, 202 controls a first steam flow 112 in a steam seal line 113 used to maintain a constant self-sustaining sealing pressure Ps to seal packings 114 of a second turbine 116. In FIG. 1, valve 102 is provided as a throttling valve positioned in leak off line 104, and in FIG. 2, valve 202 includes a diverter valve positioned between leak off line 104 and seal steam line 113, e.g., in a connector line 218 that connects lines 104 and 113. In one embodiment, valve 102 (FIG. 1) may be implemented by converting a conventional leak off re-entry stop valve, typically used to prevent roll-off during turning gear operation, to a throttling valve configuration such that it can serve both purposes. Seal steam line 113 extends from a seal packing 115 of first turbine 110 to a steam seal header (SSH) 132, described herein.

As illustrated, first turbine 110 includes a high pressure (HP) turbine coupled to a third turbine 120 in the form of an intermediate pressure (IP) turbine, and second turbine 116 includes a low pressure (LP) turbine. Turbines 110, 116, 120 may share a common shaft 121; however this is not necessary. (Note, arrows on shaft 121 indicate air or steam flow direction.) Leak off line 104 from leak packing 106 is illustrated as delivering a second steam flow 122 to third turbine 120. However, as one with skill in the art will recognize, leak off line 104 does not necessarily have to connect to another turbine. That is, second steam flow 122 may be used for other purposes. A conventional blocking valve 130 may be provided in leak off line 104 for closing and/or draining the line.

Second steam flow 112 may be regulated to a constant pressure by steam seal header (SSH) 132 that delivers steam flow to seal packing 114 of second turbine 116. In one embodiment, SSH 132 maintains a pressure of approximately 0.13 megaPascal (MPa) (approximately 18.7 psia). However, different turbines and seal packings may require different sealing pressures.

A controller 140 may be used to provide automated control of valve 102, 202 based on, for example, system load conditions. Controller 140 may include any now known or later developed industrial control mechanism, and may be included as a separate unit or part of a larger control system. Controller 140 may be coupled to any required sensors, e.g., pressure transmitter at seal packing 115 or pressure transmitter at steam seal header, to attain appropriate load conditions, and may include any required control logic necessary to control valve 102, 202.

A method of operation of steam turbine system 100 will now be described. In operation, constant self-sustaining sealing pressure Ps to LP turbine 116 is maintained using first steam flow 112, e.g., from seal steam line 113 coupled to seal packing 115 of HP turbine 110.

During part load conditions, i.e., full load conditions, first steam flow 112 is controlled using valve 102, 202 coupled to leak off line 104. (Any blocking valve 130 is fully open.). The "controlling" may manifest itself in a variety of ways capable of changing first steam flow 112, e.g., pressure, volume, etc. During full load conditions, e.g., of at least turbines 110, 120, controller 140 has valve 102, 202 deliver substantially all of second steam flow 122 through leak off line 104 to IP turbine 120 or other structure to which it is coupled. Consequently, first steam flow 112 is not impacted during maximum load conditions. However, controller 140 delivers more steam flow to seal steam line 113 during a lower load condition than during a higher load conditions, i.e., during part load conditions.

In the FIG. 1 embodiment, controller 140 throttles valve 102 positioned in leak off line 104 to restrict second steam flow 122 in the leak off line to IP turbine 120, which increases pressure P2. Consequently, more steam flow is delivered by the increased pressure P2 through seal packings 115 to first steam flow 112. The increased first steam flow 112 is used to supply SSH 132 to maintain the sealing flow requirement for LP packings 114 on LP turbine 116 without requiring additional steam from other sources, eliminating the need to pull sealing steam from other sources.

In the FIG. 2 embodiment, controller 140 has valve 202 divert a portion of second steam flow 122 from leak off line 104 to first steam flow 112, e.g., via connector line 218. Consequently, more steam flow is delivered to first steam flow 112. Again, the increased first steam flow 112 is used to supply SSH 132 to maintain the sealing flow requirement for LP packings 114 on LP turbine 116 without requiring additional steam from other sources, eliminating the need to pull steam from other sources.

In either embodiment, leak off line 104, steam seal line 113, valve 102, 202, SSH 132, etc., are designed (e.g., structured, sized, or otherwise configured) for full load conditions and to allow approximately 10% or less of the first steam flow 112 to be unused. That is, system 100 is structured such that a self-sealing load point (SSLP) of the system is greater than 90% across numerous loading conditions, indicating that 90% of the steam delivered to SSH 132 is used rather than dumped to a condenser 150. In contrast to conventional systems, however, system 100 is capable of maintaining the approximately 90% SSLP during all load conditions of operation. That is, in contrast to conventional systems that would waste or leave unused significant amounts of useful steam through delivery to condenser 150, an approximately 90% SSLP can be maintained, resulting in more efficient use of steam to produce work.

To illustrate operation, data for a conventional system compared to system 100 at different load conditions is provided.

Full load condition: Full load conditions as defined by end customer requirements (i.e., unfired case, maximum duct firing in case of combine cycle plant, rating load point for fossil and nuclear) may include, for example, system 100 operating at full load using exhaust energy from a gas turbine (not shown) to generate steam, with fuel fired in steam boiler or heat recovery steam generator (HRSG). In this case, pressure P2 at leak packings 106 is substantially equal to Pressure P1 at IP turbine 120 because there is no restriction or diversion of steam flow 122 in leak off line 104. With these load conditions, one conventional system has an SSLP of approximately 30%, meaning 70% of first steam flow 112 delivered to SSH 132 is dumped to condenser 150 or any other energy sink because it is not required for sealing the LP packings 114. In contrast, system 100 is designed to have an approximately 90% SSLP at this full load conditions without throttling or diverting second steam flow 122 in leak of line 104. Consequently, system 100 is significantly more efficient and productive at a full load condition, where overall steam performance matters more. Although one illustrative full load condition has been described, it is understood that the teachings of the invention are not limited to any particular full load condition, and different sized systems full load conditions may vary.

Mid-range load condition: One illustrative mid-range load condition (non-full load) may include system 100 operating at approximately mid-range loads, with no additional fuel in a steam boiler or HRSG but only part load gas turbine exhaust energy. In this case, one conventional system may deliver an SSLP of approximately 60 to 70% meaning 30 to 40% of first steam flow 112 delivered to SSH 132 is dumped to condenser 150 because it is not required for sealing the LP packings 114. In contrast, with valve 102, 202 set to deliver some amount of second steam flow 122 to steam seal flow 112, an SSLP of approximately 90% can be obtained using system 100. That is, with a decrease in load from maximum load conditions, steam flow going from steam seal line 113 to SSH 132 reduces, thus requiring more steam for steam seal line 113. Normally, more steam would have to be generated from other sources to accommodate this situation. In system 100, however, in terms of the FIG. 1 embodiment, valve 102 is throttled to increase upstream pressure P2 of seal packing 115 compared to pressure P1 at IP turbine 120. Since seal packing 114 pressure Ps is maintained constant by SSH 132 and upstream pressure P2 is increased by using leak off line 104 throttling, the steam flow going through sealing packing 115 and steam seal line 113 will increase. Diverting a portion of second steam flow 122 using valve 202, in the FIG. 2 embodiment, results in the same increase in steam flow to steam seal line 113. In either case, the increased steam flow to SSH 132 assists in maintaining the desired SSLP.

Lowest load conditions: A lowest load level (e.g., floor pressure) may include load levels just above a point at which turning gear power must be provided to keep rotating shaft 121 turning. In this case, one conventional system may deliver an SSLP of greater than 100%, meaning steam seal flow 112 is not enough to seal LP packings 114 and additional steam is taken from a main steam source or any other external source such as an auxiliary startup boiler. In contrast, with valve 102, 202 set to deliver some amount of second steam flow 122 to steam seal flow 112, an SSLP greater than approximately 90% can be obtained using system 100. That is, with a decrease in load conditions from a mid-range load condition, flow going from steam seal line 113 to SSH 132 continues to reduce, thus requiring more steam for steam seal line 113. Normally, more steam would have to be generated from other sources to accommodate this situation. In system 100, however, in terms of the FIG. 1 embodiment, valve 102 is further throttled to further increase upstream pressure P2 of seal packing 115 compared to pressure P1 at IP turbine 120. Since seal packing 114 pressure Ps is maintained constant by SSH 132 and upstream pressure P2 is increased by using leak off line 104 throttling, the steam flow going through sealing packing 114 and steam seal line 113 increases. Diverting a larger portion of second steam flow 122 using valve 202, in the FIG. 2 embodiment, results in the same increase in steam flow to steam seal line 113. In either case, the increased steam flow to first steam flow 112 and SSH 132 assists in maintaining the desired SSLP.

An advantage that may be realized in the practice of some embodiments of the described systems and methods is maintenance of an SSLP of approximately 90% or greater across all load condition ranges. In addition, system 100 also provides an improved heat rate ranging from, for example, approximately 0.1% (maximum load condition) to approximately 0.04% (lowest possible load condition) by dumping less steam at SSH 132. Furthermore, improved kilowatt production from, for example, approximately 0.1% (maximum load) to approximately 0.03% (lowest possible load) is also possible using system 100. System 100 also does not require as large of a condenser 150 and related structure as necessary in conventional systems.

The foregoing drawings show some of the processing associated according to several embodiments of this disclosure. In this regard, each drawing or block within a flow diagram of the drawings represents a process associated with embodiments of the method described. It should also be noted that in some alternative implementations, the acts noted in the drawings or blocks may occur out of the order noted in the figure or, for example, may in fact be executed substantially concurrently or in the reverse order, depending upon the act involved. Also, one of ordinary skill in the art will recognize that additional blocks that describe the processing may be added.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A steam turbine system comprising:

a high pressure (HP) turbine operatively coupled to an intermediate pressure (IP) turbine and a low pressure (LP) turbine;

a steam seal header for maintaining a constant self-sustaining sealing pressure to the LP turbine using a first steam flow in a seal steam line from a seal packing of the HP turbine;

a leak off line coupling a leak packing of the HP turbine to the IP turbine;

a connector line directly coupling the leak off line to the seal steam line upstream of the IP turbine;

a valve coupled to the connector line for controlling the first steam flow to the steam seal header; and a controller for controlling operation of the valve, wherein the valve delivers more steam flow to the seal steam line during a lower load condition of the IP turbine than during a higher load condition of the IP turbine such that the steam seal header uses greater than or approximately 90% of the first steam flow to maintain a sealing pressure to the LP turbine, and the steam seal header leaves approximately 10% or less of the first steam flow unused during all load conditions of the turbine system.

2. The steam turbine system of claim 1, wherein the valve includes a diverter valve for controlling the first steam flow by diverting a portion of a second steam flow from the leak off line directly to the first steam flow in the seal steam line.

3. The steam turbine system of claim 1, wherein the steam seal header sends the unused portion of the first steam flow to a condenser.

4. The steam turbine system of claim 1, wherein the leak off line further includes a blocking valve.

5. A method of operating a turbine system, the method comprising:

providing:

a high pressure (HP) turbine operatively coupled to an intermediate pressure (IP) turbine and a low pressure (LP) turbine;

a leak off line coupling a leak packing of the HP turbine to the IP turbine;

a seal steam line coupling a seal packing of the HP turbine to a seal packing of the LP turbine by way of a steam seal header;

a connector line directly coupling the leak off line to the seal steam line upstream of the IP turbine; and a valve coupled to the connector line; and maintaining a constant self-sustaining sealing pressure to the LP turbine by:

controlling the valve coupled to the connector line to deliver more steam to a first steam flow within the seal steam line during a lower load condition of the IP turbine than during a higher load condition of the IP turbine, such that the steam seal header uses greater than approximately 90% of the first steam flow and the steam seal header leaves approximately 10% or less of the first steam flow unused during all load conditions of the turbine system.

6. The method of claim 5, wherein the controlling includes diverting a portion of a second steam flow from the leak off line to the first steam flow in the steam seal line using the valve in the connector line.

7. The method of claim 5, wherein the steam seal header sends the unused portion of the first steam flow to a condenser.

8. A steam turbine system comprising:

a high pressure (HP) turbine operatively coupled to an intermediate pressure (IP) turbine and a low pressure (LP) turbine;

a steam seal header coupled to a seal packing of the LP turbine for maintaining a constant self-sustaining sealing pressure to the LP turbine;

a first steam flow within a seal steam line coupling a seal packing of the HP turbine to the steam seal header;

a leak off line coupling a leak packing of the HP turbine to the IP turbine;

a connector line directly coupling the leak off line to the steam seal line upstream of the IP turbine and the steam seal header;

a valve coupled to the connector line for controlling the first steam flow to the steam seal header;

a blocking valve positioned in the leak off line upstream of the valve coupled to the connector line; and a controller for controlling operation of the valve, wherein the valve delivers more steam flow to the seal steam line during a lower load condition of the IP turbine than during a higher load condition of the IP turbine such that the steam seal header uses greater than approximately 90% of the first steam flow to maintain a sealing pressure to the LP turbine and the steam seal header sends approximately 10% or less of the first steam flow to a condenser during all load conditions of the turbine system.

9. The turbine system of claim 8, wherein the valve includes a diverter valve for controlling the first steam flow by diverting a portion of a second steam flow within the leak off line to the first steam flow within the seal steam line.

* * * * *